US005153995A

United States Patent [19]

Opinel

[11] Patent Number: 5,153,995

[45] Date of Patent: Oct. 13, 1992

[54] FOLDING KNIFE

[75] Inventor: Denis M. J. Opinel, Chambery, France

[73] Assignee: Etablissements Joseph Opinel & Cie, France

[21] Appl. No.: 734,544

[22] Filed: Jul. 23, 1991

[30] Foreign Application Priority Data

Jul. 23, 1990 [FR] France ..... 90 09383

[51] Int. Cl.[5] ..... B26B 1/04

[52] U.S. Cl. ..... 30/161; 30/331

[58] Field of Search ..... 30/155, 160, 161, 331, 30/340, 156–159

[56] References Cited

U.S. PATENT DOCUMENTS 633,854 9/1899 Kuhn ..... 30/160
2,098,678 11/1937 Schrade ..... 30/159
4,535,539 8/1985 Friedman et al. ..... 30/161

FOREIGN PATENT DOCUMENTS 2516844 5/1983 France .

*Primary Examiner*—Douglas D. Watts
*Attorney, Agent, or Firm*—Ostrolenk, Faber, Gerb & Soffen

[57] ABSTRACT

This invention relates to a folding knife including a blade having a heel pivotally mounted onto an intermediate member made of plastic or composite material, provided with a blade-spring co-operating with the blade heel, and inserted, then stuck within a recess provided in one end of a wooden handle.

4 Claims, 1 Drawing Sheet

FOLDING KNIFE

BACKGROUND OF THE INVENTION

1. Field of the Invention

The present invention relates to an improved folding knife.

2. Description of the Related Art

Folding knives having a wooden handle onto which a blade is pivotally mounted have been known for many years.

However, the wood of the handle may become swollen when subject to moisture, so that the friction of the blade heel during its pivotal movement with respect to the handle makes the blade difficult to open and close.

Furthermore, the mounting of the blade onto the handle requires a certain number of operations which, during mass production, may increase the price of the knives.

SUMMARY OF THE INVENTION

Therefore, the object of the present invention is to overcome the above drawbacks by providing a foldable knife in which the blade heel is pivotally mounted onto a plastic, composite or the like intermediate member which is attached to the handle of the knife by a secure press fit in a recess provided in the handle.

The knife also includes a blade-spring which is secured by any appropriate means such as clipping, fitting, molding or like means to the intermediate member, the blade-spring co-operating with the blade heel for resiliently retaining the same in the open or closed position.

In the present invention, there is no problem positioning the blade-spring on the handle, since the blade-spring is integral with the intermediate member and these two elements together form a unit which is easily and securely fit into the end of the handle, whereby the manufacture of the knife is greatly simplified.

According to another feature of the knife of the present invention, the shape of the intermediate member is such that, upon insertion of the intermediate member into the recess of the handle, a slot provided in the intermediate member for pivotally receiving the blade heel is automatically aligned with the slot of the handle adapted to receive the blade in the folded position.

The end of the intermediate member projecting from the handle preferably includes a pad or the like which protects that end against impact from the blade heel during opening of the knife.

The folding knife according to this invention may also include a metal sleeve mounted at the end of the intermediate member projecting from the handle.

BRIEF DESCRIPTION OF THE DRAWINGS

Other features and advantages of the invention will be more apparent from the following detailed description which refers to the annexed drawings, where.

DETAILED DESCRIPTION OF THE PREFERRED EMBODIMENTS

Figure 1:
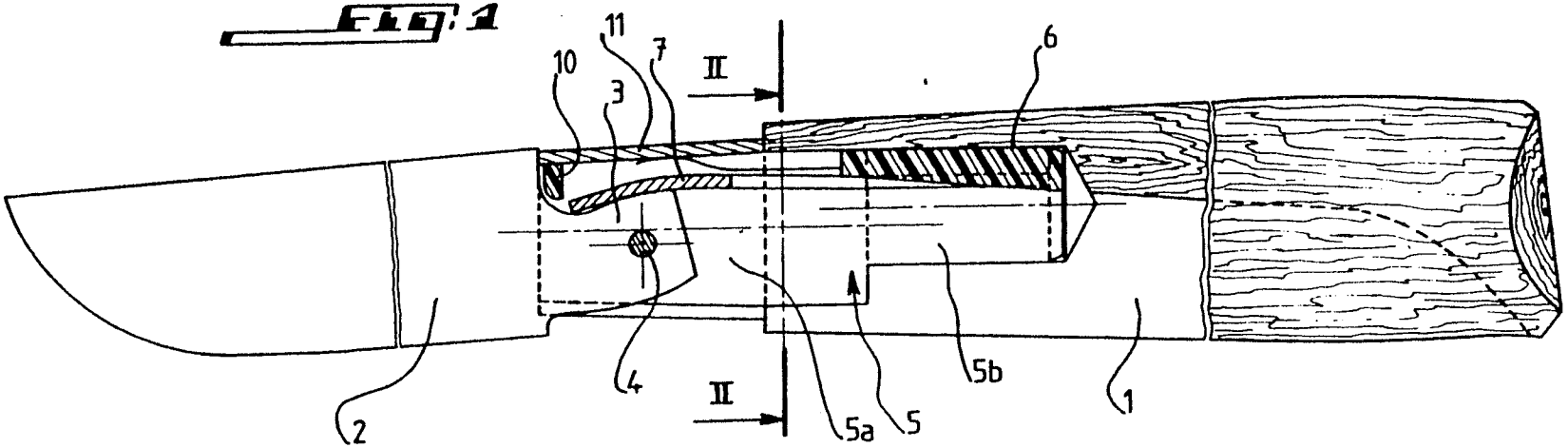
FIG. 1 is a side elevation view, partly in section, of a folding knife according to this invention.
Figure 2:
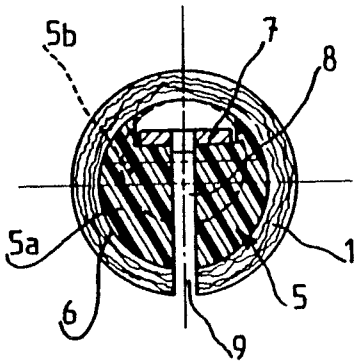
FIG. 2 is a cross-sectional view taken substantially along the line II—II in FIG. 1.

As shown in the Figures, the folding knife of the invention comprises a handle 1 preferably made of wood onto which a blade 2 including a heel 3 is pivotally mounted.

According to the invention, the heel 3 of the blade 2 is pivotally mounted about an axis 4 on an intermediate member 5 made of a plastic, composite or like material, the intermediate member being inserted and securely held by way of a press fit in a recess 6 at one end of the handle 1.

Reference number 7 identifies a blade-spring adapted to co-operate with the blade heel 3 and secured to the intermediate member 5 through clipping, fitting or the like and preferably through molding with the intermediate member. The intermediate member includes a portion 5*a* which projects from the handle 1, as clearly seen in FIG. 1.

Therefore, the intermediate member 5 and the blade-spring 7 constitute a single unit which, on the one hand, includes a slot 8 in which the heel 3 of the blade 2 may be easily pivotally mounted at point 4 and which, on the other hand, can be immediately secured by way of a press fit into the recess 6 of the handle 1 and, as may be well understood, this facilitates the manufacture of the knife considerably with respect to a conventional knife which includes a blade-spring such as 7.

The intermediate member 5 may have a simple cylindrical shape adapted to fit, at its end 5*b*, into a correspondingly shaped recess, the recess also being cylindrical.

According to the specific embodiment shown in the Figures, the intermediate member 5 is formed of two offset cylindrical portions identified as portions 5*a* and 5*b* respectfully, ensuring the centered fit of the member 5 into the recess 6 having a corresponding shape. It is apparent that, with such a configuration, upon insertion of the member 5 into the recess 6, the slot 8 provided in the member 5 for receiving the heel 3 of the blade 2 will be automatically aligned with the slot 9 provided on the handle 1 for receiving the blade 2 in its folded position.

It is important to note here that the intermediate member 5, being made of a plastic or composite material, will remain insensitive to humidity, so that the friction during the pivotal movement of the heel 3 of the blade 2 will be always the same, which was not the case with a blade pivotally and directly mounted onto the wooden handle of the knife. Furthermore, the pivotal attachment of the blade 2 onto the intermediate member 5 will raise no particular problem and will not require any particular care with regard to the friction between the blade 2 and the member 5.

In FIG. 1, reference numeral 10 identifies a pad or the like protecting the end 5*a* of the intermediate member 5 against the possible impact of heel 3 of the blade 2 during the opening thereof to the position shown in FIG. 1.

Also, the end 5*a* of the intermediate member 5 can be surrounded with a metal sleeve 11, although such a sleeve is not compulsory. If a sleeve is used, the periphery of the projecting end 5*a* of the member 5 will be totally protected by the sleeve 11, which further imparts to the knife a particular and aesthetic aspect.

Therefore, the present invention provides a folding knife which may be easily and cheaply manufactured even though it includes a blade-spring acting upon the blade heel, and which will present no irregularity or defect of friction during pivotal movement of said blade, regardless of the conditions of use of the knife.

Of course, the invention is by no means limited to the embodiment disclosed and shown in the drawings.

For example, the intermediate member and the recess in the handle may simply be cylindrical. Also, the plastic or composite material constituting the intermediate member may be of any type provided, however, that the intermediate member is rigidly secured to the handle by being press fit into the recess thereof. Lastly, the blade-spring may have any shape and may be secured to the intermediate member in any manner.

Therefore, the invention comprises any technical equivalent means to those described means and their combination if effected in the spirit of the invention.

What is claimed is:

1. An improved folding knife comprising a wooden handle, a recess provided in said handle, a cylindrical plastic intermediate member mounted at one end in said recess and having an opposite end projecting from said handle, a blade including a heel portion pivotally mounted on said projecting end of said plastic intermediate member, and a blade spring having a first end adjoining said plastic member in said recess and extending from said recess in a substantially parallel relationship therewith and a second end cooperating with the heel portion of the blade for biasing the blade in an open position when said knife is open and in a closed position when said knife is closed.

2. An improved folding knife comprising a wooden handle, a recess provided in said handle, a plastic intermediate member mounted at one end in said recess and having an opposite end projecting from said handle, a blade including a heel portion pivotally mounted on said projecting end of said plastic intermediate member, and a blade spring having a first end adjoining said plastic member in said recess and extending from said recess in a substantially parallel relationship therewith and a second end cooperating with the heel portion of the blade for biasing the blade in an open position when said knife is open and in a closed position when said knife is closed, wherein said plastic intermediate member is provided with a slot for receiving the heel of the blade and said handle is provided with a slot for receiving the blade in the closed position, and wherein said plastic intermediate member comprises two offset cylindrical portions and the recess has a corresponding shape, so that, upon insertion of said plastic intermediate member into said recess, the slot provided in said plastic intermediate member for receiving the heel of the blade is automatically aligned with the slot provided in the handle for receiving the blade in the closed position.

3. An improved folding knife comprising a wooden handle, a recess provided in said handle, a plastic intermediate member mounted at one end in said recess and having an opposite end projecting from said handle, a blade including a heel portion pivotally mounted on said projecting end of said plastic intermediate member, and a blade spring having a first end adjoining said plastic member in said recess and extending from said recess in a substantially parallel relationship therewith and a second end cooperating with the heel portion of the blade for biasing the blade in an open position when said knife is open and in a closed position when said knife is closed, wherein said projecting end of the plastic intermediate member includes a pad for protecting said end against impact from the blade heel when the blade is opened.

4. An improved folding knife comprising a wooden handle, a recess provided in said handle, a plastic intermediate member mounted at one end in said recess and having an opposite end projecting from said handle, a blade including a heel portion pivotally mounted on said projecting end of said plastic intermediate member, and a blade spring having a first end adjoining said plastic member in said recess and extending from said recess in a substantially parallel relationship therewith and a second end cooperating with the heel portion of the blade for biasing the blade in an open position when said knife is open and in a closed position when said knife is closed, said folding knife further comprising a metal sleeve surrounding the projecting portion of the plastic intermediate member.

* * * * *